United States Patent [19]

Woloszczuk

[11] Patent Number: 4,528,568

[45] Date of Patent: Jul. 9, 1985

[54] SLOTTED DIPOLE WITH THREE LAYER TRANSMISSION LINE FEED

[75] Inventor: Edmund W. Woloszczuk, Chelmsford, England

[73] Assignee: The Marconi Company Limited, Stanmore, England

[21] Appl. No.: 457,453

[22] Filed: Jan. 12, 1983

[30] Foreign Application Priority Data

Jan. 15, 1982 [GB] United Kingdom ..... 8201084
Jun. 7, 1982 [GB] United Kingdom ..... 8216515
Nov. 15, 1982 [GB] United Kingdom ..... 8232564

[51] Int. Cl.[3] ..... H01Q 21/08; H01Q 9/28

[52] U.S. Cl. ..... 343/816; 343/770; 343/807; 343/846

[58] Field of Search ..... 343/767–771; 343/794, 795, 700 MS, 746, 708, 816–818, 846, 834, 829, 807

[56] References Cited

U.S. PATENT DOCUMENTS 2,555,443 6/1951 Harvey ..... 343/767
2,586,895 2/1952 Willoughby ..... 343/770
2,820,220 1/1958 Charman ..... 343/767
2,860,339 11/1958 Kandoian ..... 343/795
4,319,249 3/1982 Evans et al. ..... 343/795

FOREIGN PATENT DOCUMENTS 103356 8/1978 Japan .

*Primary Examiner*—Eli Lieberman
*Assistant Examiner*—Michael C. Wimer
*Attorney, Agent, or Firm*—Spencer & Frank

[57] ABSTRACT

An antenna arrangement consists of a dipole radiator which is fed via a Triplate three-layer transmission line. The dipole is arranged to radiate and receive plane polarized electro-magnetic radiation having a plane of polarization which is determined by the orientation of an elongate slot in the dipole radiator. The Triplate is coupled to the dipole so as to maintain a substantially constant impedance over a reasonably wide bandwidth. A large number of similar dipole radiators can be mounted side by side and fed from a common Triplate structure and in this latter case a common reflector is used for all dipoles and is mounted on the Triplate structure itself.

10 Claims, 9 Drawing Figures

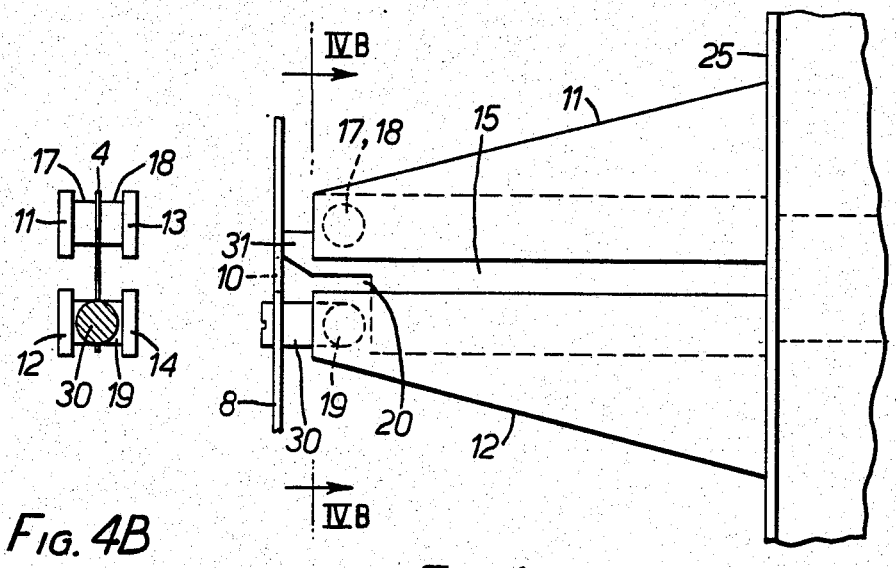
FIG. 4B
FIG. 4A
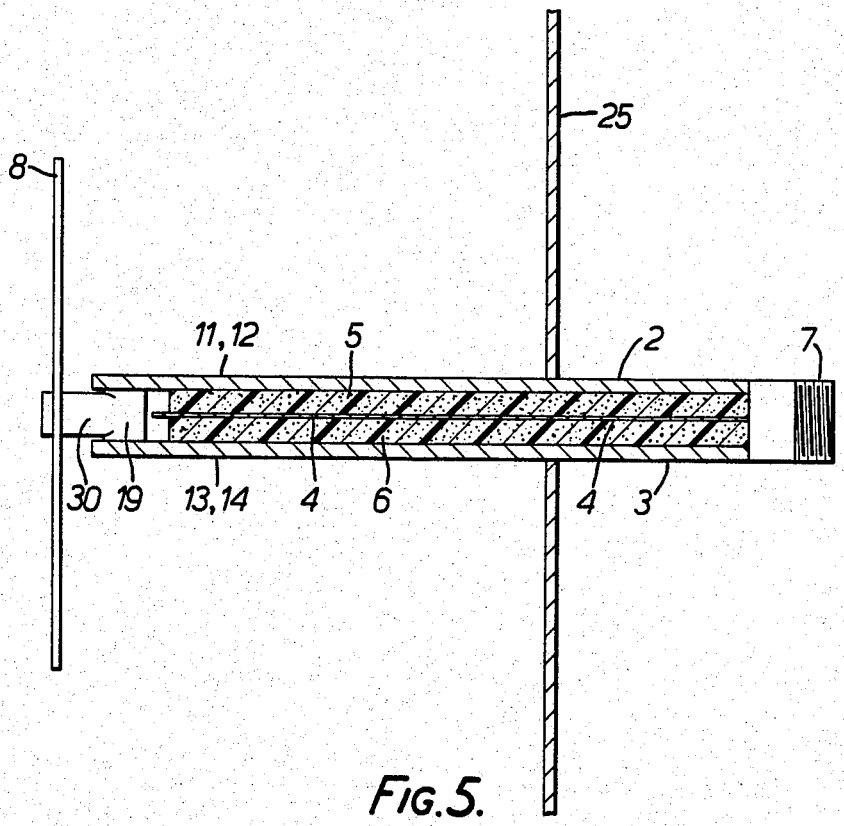
FIG. 5.

SLOTTED DIPOLE WITH THREE LAYER TRANSMISSION LINE FEED

BACKGROUND OF THE INVENTION

This invention relates to antennas which are suitable for transmitting and receiving plane polarised electromagnetic radiation at a very high frequency, typically in excess of 1 GHz. A dipole is particularly suitable for this purpose, but it has proved difficult to satisfactorily produce an antenna arrangement containing an array of dipoles in which the impedance of the dipole is acceptably constant over a reasonably broad bandwidth. Where a large number of dipoles form part of the antenna arrangement, it is convenient to feed each via a Triplate three-layer transmission line (sometimes termed strip line), if the dipoles lie in the same plane as the Triplate, but the electrical performance can be rather unsatisfactory. The present invention seeks to provide an improved dipole antenna arrangement which utilises a triplate feeder.

SUMMARY OF THE INVENTION

According to this invention, an antenna includes a Triplate transmission line having an elongate central conductor sandwiched between two ground planes both of which terminate in two narrow extensions thereof which are separated by two respective longitudinal slots aligned with each other and the elongate central conductor, the ends of that pair of extensions lying to one side of the longitudinal slots both being electrically connected to said central conductor, and the ends of the other pair of extensions being connected together; a dipole radiator comprising two co-planar plate portions spaced apart by an elongate aperture, the two plate portions being electrically connected together at each end of the elongate aperture, and a mid-point on each side of the aperture being electrically connected to respective ones of said pairs of said extensions; and a planar reflector mounted at the base of said extensions so as to be substantially parallel to said dipole radiator and perpendicular to the Triplate transmission line.

In order for the antenna to handle radiation which is plane polarised parallel to the plane of the triplate transmission line, the elongate aperture in the dipole radiator is disposed perpendicularly to the plane of the Triplate transmission line, whereas for radiation which is plane polarised perpendicular to the plane of the transmission line, the elongate aperture is aligned with the plane of the transmission line itself.

By correctly choosing the shape and size of the elongate aperture between said two plate portions, the input impedance of the dipole radiator can be made substantially equal to the characteristic impedance of the Triplate transmission line over a reasonably wide bandwidth. Correct impedance matching is important to prevent undesirable energy loss, either when the antenna is operative to radiate energy, or when it is operative to receive energy.

The extensions of the ground plane can be shaped so as to provide an impedance transformation between that of the body of the Triplate transmission line, and that of the dipole reflector.

Conveniently, the two co-planar plate portions of the dipole radiator form part of a single continuous conductive sheet having the elongate aperture formed within it. In order to provide the correct characteristic impedance, the elongate aperture is preferably provided at each end with portions which are considerably wider than the width of the aperture at the mid-point. Preferably the elongate apertures takes the form of an H. Although it is desirable to make electrical connection to both sides of the elongate aperture at its mid-points the actual position is not crital and in particular the two points need not be exactly opposite each other.

The Triplate consists of two ground planes which sandwich between them a central conductor in conventional manner—a construction of this kind is sometimes called "stripline". Preferably the central conductor is spaced apart from each of the two ground planes by a layer of rigid dielectric material, although alternatively an air gap can be provided. The invention is particularly applicable to antenna arrangements which contain a large number of similar dipoles mounted side by side, and in such a case preferably a plurality of dipole radiators are connected to a common triplate structure. That is to say, the two ground planes are common, although each Triplate transmission line will possess its own separate central conductor. Preferably a common elongate reflector is provided for all of the dipoles which are mounted on the common Triplate structure.

BRIEF DESCRIPTION OF THE DRAWINGS

FIG. 4A shows a plan view of an antenna in accordance with this invention, arranged for radiation in a plane which is aligned with that of the Triplate structure, and FIG. 4B is a fragmentary sectional view taken along the line IVB—IVB in FIG. 4A to show the distribution of elements immediately behind the dipole radiator, FIGS. 5 and 6 show respectively a side sectional view and a front elevation of the antenna.

DESCRIPTION OF THE PREFERRED EMBODIMENTS

Figure 1:
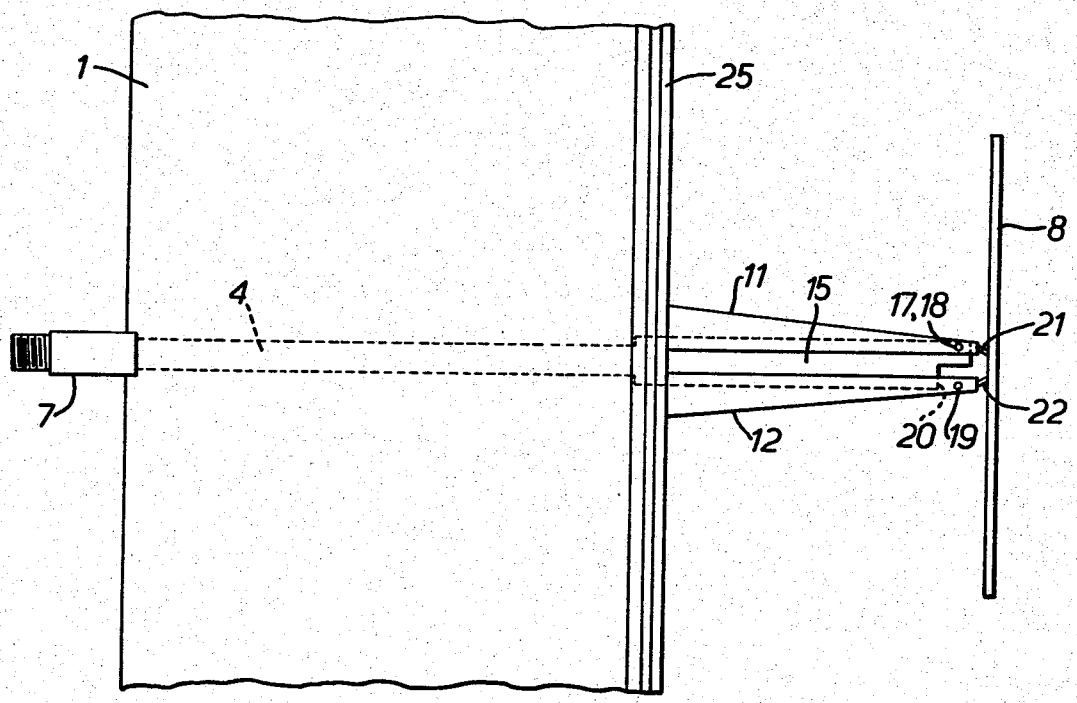
FIG. 1 shows a plan view of an antenna in accordance with this invention, arranged for radiation in a plane which is perpendicular to that of the Triplate three-layer transmission line structure, and FIGS. 2 and 3 respectively show side and front elevations of the antenna.

Referring to FIGS. 1, 2, 3, 4A, 4B, 5 and 6 the antenna comprises a Triplate transmission line structure 1 which itself can be of conventional form, that is to say, it consists of two ground planes 2,3 which sandwich between them an elongate conductor 4, which is relatively narrow and very thin. The two ground planes 2,3 are spaced apart from the central conductor by sheets 5,6 of rigid dielectric material such as a suitable polyurethane foam. For ease of construction the conductor 4 can be formed as a thin foil printed onto a thin flexible insulating substrate, but the substrate is not separately shown, as its thickness is negligible as compared with that of the sheets 5 and 6. The central conductor 4, together with the two ground planes 2 and 3 comprises a transmission line which in operation is connected to an unbalanced transmission line (not shown but which takes the form of a co-axial cable) by a connector 7. The transmission line serves to connect the connector 7 to a half-wavelength dipole radiator 8. The dipole radiator 8 comprises a flat sheet of metal having an elongate aperture 10 formed centrally in it to define two flat co-planar portions 91 and 92 on either side of it. Each end of the aperture is locally widened so that overall the aperture is in the form of an H. The dimensions of the plate radiator 8 and the aperture 10 determine the effective impedance of the dipole radiator, and this determines the effective bandwidth of the antenna.

Although the dipole radiator is nominally a half-wavelength radiator, it is capable of operating over a band of frequencies, the bandwidth of which depends on the size and shape of the plate.

The dipole radiator 8 is coupled to the triplate structure 1 by four extensions, 11,12,13,14 of the ground planes 2 and 3. The two extensions 11 and 12 form part of the upper ground plane 2 and are separated from each other by a longitudinal slot 15 which is approximately a quarter wavelength long. Similarly, the extensions 13 and 14 of the lower ground plane 3 are provided with a similar slot 16 which is aligned with the slot 15 and with the central conductor 4. The pair of extensions 11 and 13 which lie on one side of the slots, 15 and 16 are each connected to the central conductor 4 by means of electrically conductive pins 17 and 18 whereas the other two extensions 12 and 14 are directly connected together by a link 19. The end of the central conductor 4 is provided with a suitable cut-out 20 as to clear the link 19.

A reflector plate 25 is mounted on the triplate structure at the base of the extensions 11,12,13,14 so as to be perpendicular to the plane of the Triplate structure.

In operation, a high frequency signal, typically in excess of 1 GHz is coupled via a co-axial cable to the connector 7 and is transmitted along the transmission line to the dipole radiator 8. It is radiated as a plane polarised wave having a plane of polarisation which is determined by the orientation of the aperture 10 with respect to the plane of the Triplate structure 1. The antenna is, of course, a reciprocal device and it is operative in a similar manner to receive a high frequency signal and the appropriate plane polarised components of the received signal are coupled by the antenna to the conductor 7 for utilisation as required.

Figure 2:
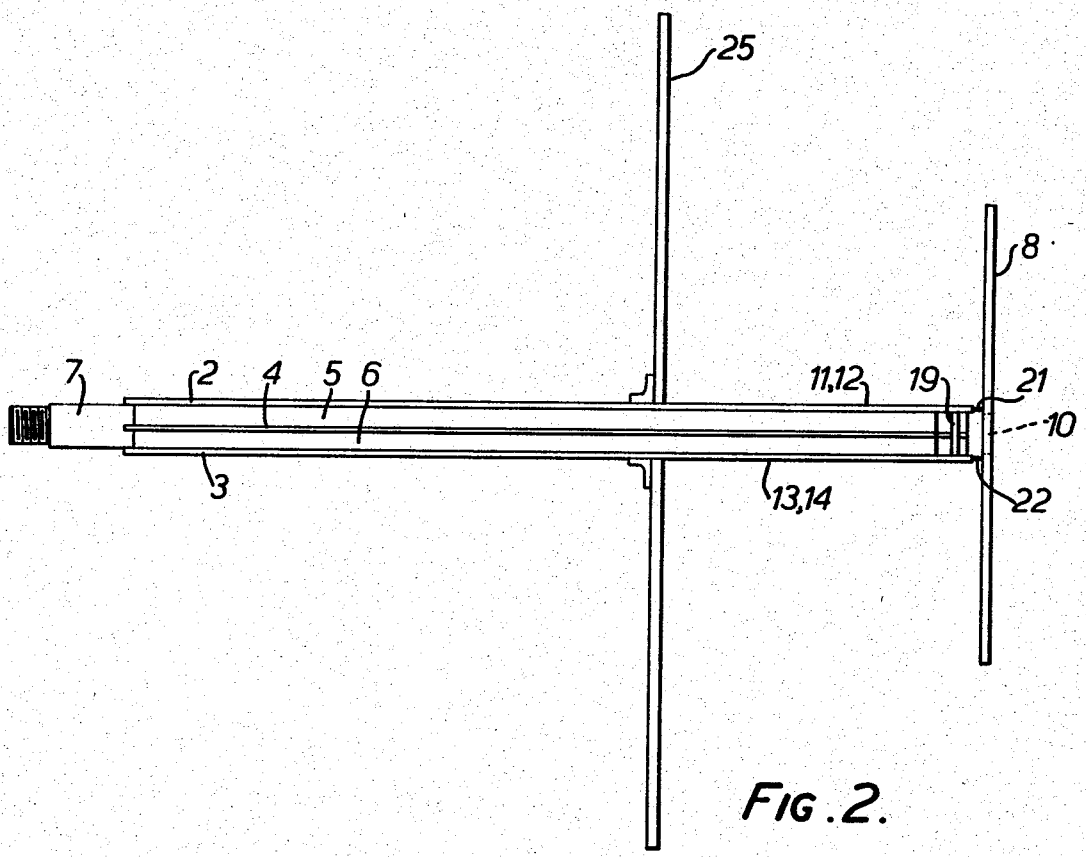
Figure 3:
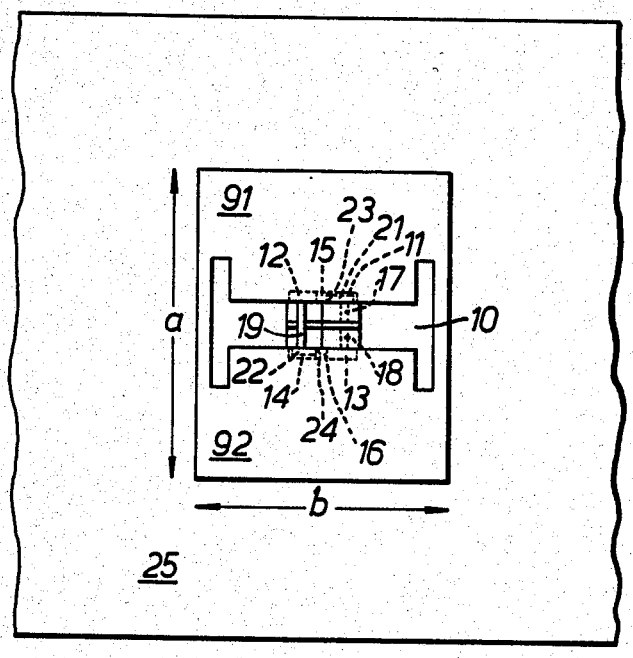

Referring specifically to FIGS. 1,2 and 3 it will be noted that the cross bar of the H is aligned with the plane of the Triplate structure 1 and because of this the antenna handles radiation which is plane polarised perpendicular to the plane of the Triplate structure. The dipole 8 is mounted on the Triplate structure by two thin electrically conductive links 21 and 22, the link 21 extending from the tip of the extension 11 to the mid-point 23 of the upper edge of the aperture 10, and the other link extending from the tip of the diagonally opposite extension 14 to the mid-point 24 of the lower edge of the aperture 10. These mid-points are approximate only, and need not lie exactly one above the other.

As mentioned previously the bandwidth of the dipole radiator depends on the size and shape of the plate. The bandwidth is increased as the width a (see FIG. 3) is increased, but as the width a increases, the length b must be correspondingly reduced to maintain a given centre frequency of operation. Typically the width a is between $\frac{1}{4}\lambda$ and $\frac{3}{8}\lambda$, and the length b is between $\frac{1}{2}\lambda$ and $\frac{1}{3}\lambda$.

Referring specifically to FIGS. 4A, 4B, 5, and 6, it will be noted that the cross bar of the H is perpendicular to the plane of the Triplate structure 1. Thus the antenna handles radiation which is plane polarised in the plane of the Triplate structure itself. The dipole 8 is mounted on the Triplate structure by means of a stub 30 extending from the link 19, and by the end 31 of the conductor 4, which respectively are connected to the mid-point 32 of one edge of the aperture 10, and to the mid-point 33 of the other edge of the aperture 10. These mid-points are approximate only, and need not lie exactly opposite each other.

Figure 7:
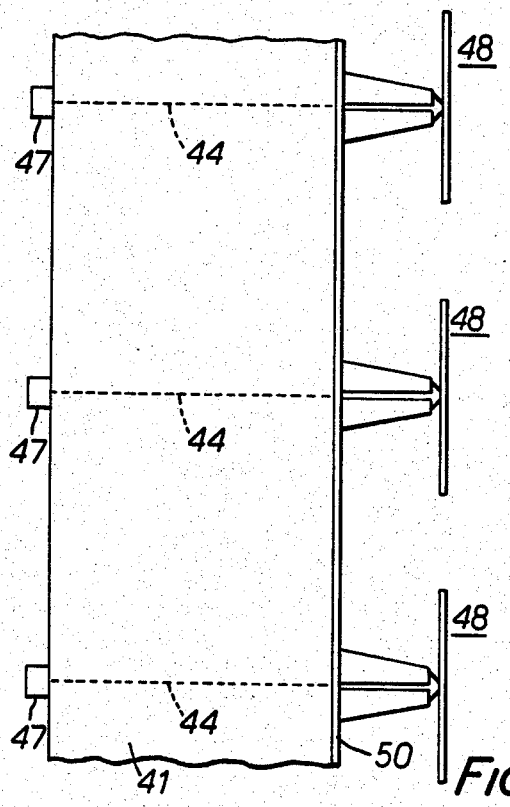
FIG. 7 shows an antenna arrangement having a plurality of dipole radiators.

The invention is particularly applicable to large antenna arrangements containing a great many individual dipole radiators. An antenna arrangement of this kind is illustrated diagrammatically in FIG. 7. A common Triplate structure 41 is similar in construction to the structure 1 described with reference to the preceding Figures. A number of similar dipole radiators 48 are coupled to respective connectors 47 via central conductors 44 positioned between the two ground plates of the triplate structure 41. A common reflector plate 50 is provided for all of the dipole radiators 48.

By controlling the relative phases of the high frequency signal transmitted by the difference dipole radiators they can be arranged to combine constructively so as to produce a narrow steerable beam of electromagnetic energy. In order to produce a very narrow beam having low side lobes, it is desirable to provide a very large number of individual dipole radiators. The form of construction illustrated enables this requirement to be met with precision and at relatively low cost. Although only a two dimensional array of dipole radiators is shown, a three dimensional array can easily be made by stacking a large number of individual Triplate structures one above the other.

Figure 8:
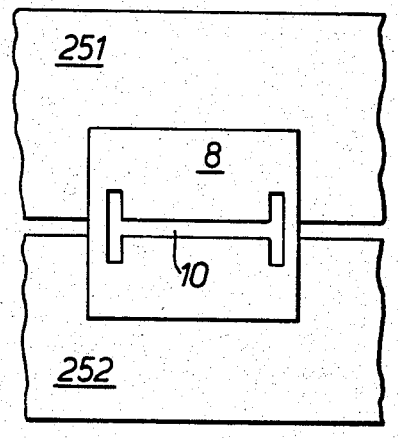
FIG. 8 shows an antenna having a modified reflector.
Figure 6:
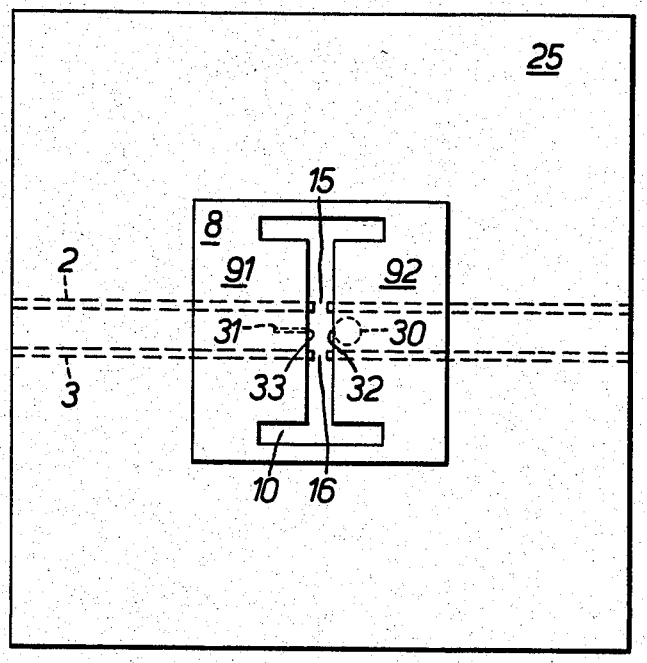

In FIG. 3, the reflector 25 is shown as a single plate mounted on the edge of the Triplate structure. In some instances it may be more convenient to make it in two pieces 251 and 252, as shown in FIG. 8, the dipole radiator 8 itself being unchanged and containing aperture 10 as previously.

I claim:

1. An antenna including a three-layer transmission line having an elongate central conductor sandwiched between two ground planes both of which terminate in two narrow extensions thereof which are separated by two respective longitudinal slots aligned with each other and the elongate central conductor so that a pair of extensions is disposed on either side of a plane passing through the slots and central conductor, the ends of that pair of extensions lying to one side of the plane both being electrically connected to said central conductor, and the ends of the other pair of extensions being connected together; a dipole radiator comprising two co-planar plate portions spaced apart by an elongate aperture, the two plate portions being electrically connected together at each end of the elongate aperture, and a mid-point on each side of the aperture being electrically connected to respective ones of said pairs of said extensions; and a planar reflector mounted at the base of said extensions so as to be substantially parallel to said dipole radiator and perpendicular to the three-layer transmission line.

2. An antenna as claimed in claim 1 and wherein the two co-planar plate portions of the dipole radiator form part of a single continuous conductive sheeting having the elongate aperture formed within it.

3. An antenna as claimed in claim 2 and wherein the elongate aperture is provided at each end with portions which are considerably wider than the width of the aperture at the mid-point.

4. An antenna as claimed in claim 1 and including a common three-layer transmission line structure and a common reflector, and a plurality of separate dipole radiators.

5. An antenna as claimed in claim 1 wherein said elongated central conductor of said three-layer transmission line is disposed in a transmission line plane and wherein, in order for the antenna to handle radiation which is plane polarised parallel to the three-layer transmission line, the elongate aperture in the dipole radiator is disposed perpendicularly to the transmission line plane.

6. An antenna as claimed in claim 5 and wherein the elongate aperture takes the form of an H, in which the cross bar of the H is perpendicular to the transmission line plane.

7. An antenna as claimed in claim 1 wherein said elongated central conductor of said three-layer transmission line is disposed in a transmission line plane, and wherein in order for the antenna to handle radiation which is plane polarised perpendicular to the three-layer transmission line, the elongate aperture in the dipole radiator is aligned with the transmission line plane.

8. An antenna as claimed in claim 2 wherein said elongated central conductor of said three-layer transmission line is disposed in a transmission line plane and wherein in order for the antenna to handle radiation which is plane polarised perpendicular to the plane of the three-layer transmission line, the elongate aperture in the dipole radiator is aligned with the transmission line plane.

9. An antenna as claimed in claim 3 wherein said elongated central conductor of said three-layer transmission line is disposed in a transmission line plane and wherein in order for the antenna to handle radiation which is plane polarised perpendicular to the plane of the three-layer transmission line, the elongate aperture in the dipole radiator is aligned with the transmission line plane.

10. An antenna as claimed in claim 4 wherein said elongated central conductor of said three-layer transmission line is disposed in a transmission line plane and wherein in order for the antenna to handle radiation which is plane polarised perpendicular to the plane of the three-layer transmission line, the elongate aperture in the dipole radiator is aligned with the transmission line plane.

* * * * *